US005664351A

United States Patent [19]

Jonas

[11] Patent Number: 5,664,351

[45] Date of Patent: Sep. 9, 1997

[54] METHOD AND APPARATUS FOR ANIMATED DISPLAY

[76] Inventor: Jack M. Jonas, 12823 Texaco Rd., Houston, Tex. 77013

[21] Appl. No.: 489,790

[22] Filed: Jun. 13, 1995

[51] Int. Cl.[6] ..... G09F 19/08

[52] U.S. Cl. ..... 40/415; 40/411; 446/332; 104/53; 104/126

[58] Field of Search ..... 40/411, 414, 415; 446/332, 352, 357, 444; 104/53, 55, 61, 126; 238/10 E, 10 F

[56] References Cited

U.S. PATENT DOCUMENTS

| | | | |
|---|---|---|---|
| 2,348,250 | 5/1944 | Gardner et al. | 40/411 |
| 2,874,496 | 2/1959 | Rakes | 40/411 X |
| 2,960,782 | 11/1960 | Watkins | 40/415 |
| 3,806,399 | 4/1974 | Cocjin . | |
| 4,011,674 | 3/1977 | Jacobson . | |
| 4,903,424 | 2/1990 | Satoh et al. . | |
| 4,970,810 | 11/1990 | Liou . | |
| 4,973,891 | 11/1990 | Tzeng . | |
| 4,983,890 | 1/1991 | Satoh et al. . | |
| 5,056,249 | 10/1991 | Sakurai . | |
| 5,090,936 | 2/1992 | Satoh et al. . | |
| 5,443,188 | 8/1995 | Kotlarsky et al. | 40/414 X |
| 5,450,682 | 9/1995 | Franco et al. | 40/414 X |

*Primary Examiner*—Brian K. Green

[57] ABSTRACT

A method and apparatus for creating an animated display with an ornamental object that incorporates a unique combination of motions and appearances which can be controlled and choreographed with the use of a computer or other control devices. One specific embodiment is a tree-like sculpture which can be instructed to move and dance along with selected music for purposes of entertainment. The apparatus is capable of making many different motions including linear movement, spinning, swaying, bobbing, expanding, and tumbling.

14 Claims, 4 Drawing Sheets

38
10
28
26
24
26
36
28
90
30
40
26
34
98
96
94
32
CONT.
27
92
12
16
14
16
18
20
22
18

FIG. 4
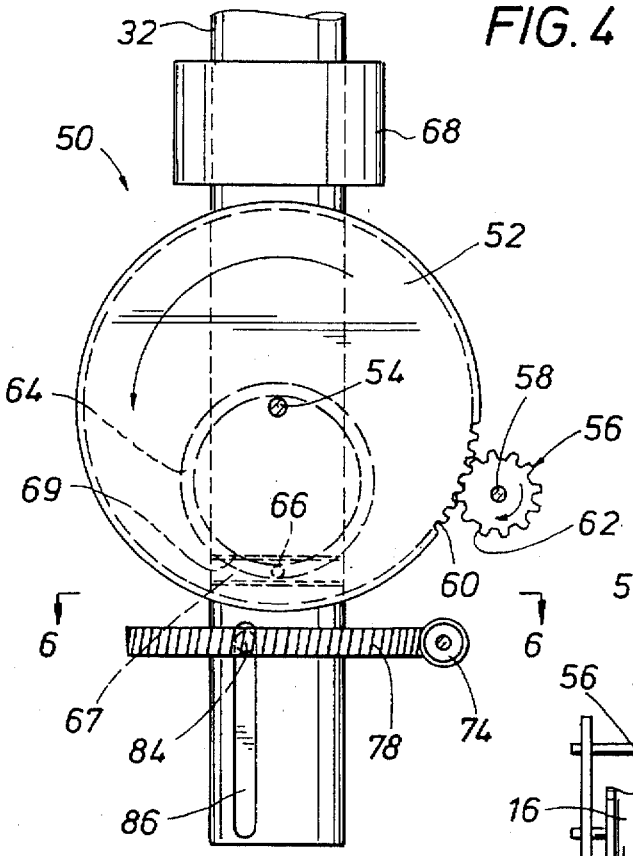
FIG. 5
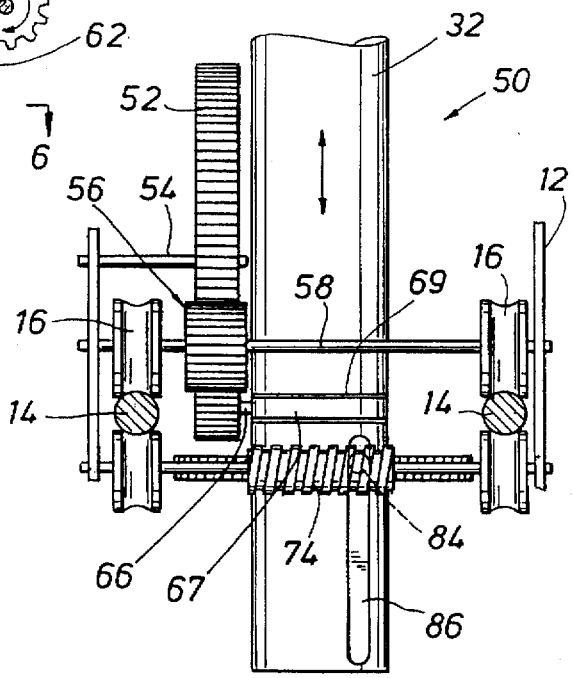
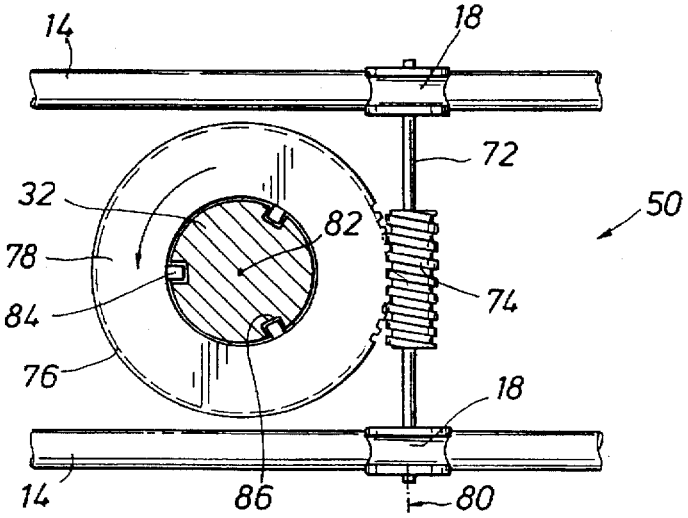
FIG. 6

METHOD AND APPARATUS FOR ANIMATED DISPLAY

FIELD OF THE INVENTION

The present invention relates to a method and apparatus for creating an animated display of normally inanimate objects. More particularly, the present invention incorporates a unique combination of motions and appearances which can be controlled and choreographed with the use of a computer or other control devices. One specific embodiment is a tree-like sculpture which can be instructed to move and dance along with selected music for purposes of entertainment.

BACKGROUND OF THE DISCLOSURE

Ornamental displays or decorations are used to provide attractive or festive atmospheres in homes, churches, businesses, malls, parks, public areas, and the like. For example, Christmas decorations are commonly put out several weeks prior to the actual holiday for a variety of purposes. Decorations in the home or church may take on a very personal or private nature or, on the other hand, they may provide a means for people to express their feelings to others who visit or pass by.

Decorations and displays are also used by businesses to promote or advertise their products and services. These decorations may take the form of their product, trademark, symbol or mascot. For example, it has become quite popular to display large air filled balloons configured as soda pop cans, cartoon characters, or the like at outdoor sporting events. Other examples of uses for displays include conferences, festivals, celebrations, theme parks, and the like.

The simplest forms of displays include two dimensional images such as pictures, charts and printed advertisements. Other displays may involve a two dimensional video image that includes shows movement. Three dimensional displays, such as Christmas trees and decorations, religious symbols, and large mockups of commercial products, typically do not provide for any movement within the display itself. Occasionally you may notice a billboard having a picture of an automobile with rotating wheels or a store window sign with a flag that waves, but these displays are generally limited to one or two motions. Furthermore, these motions, i.e., jittering, vibrating, etc., are typically randomly generated as opposed to a sequence of different motions in timed coordination with some other signal, such as music.

It would be desirable to have a display that would accommodate more than just one or two motions. A display capable of making several simultaneous motions will attract more attention and provide more entertainment for onlookers or customers. It would be most desirable if a display were available that could create the appearance that a particular normally inanimate symbol, product, emblem or mascot was performing a choreographed dance.

SUMMARY OF THE INVENTION

The present invention provides a method and apparatus for creating an animated display that incorporates a unique combination of motions and appearances which can be controlled and choreographed with the use of a computer or other control devices. More particularly, the present invention provides a mechanical display for producing choreographed movement of an ornamental object, the display comprising:

a base having a set of rollers and a first motor coupled to at least one of the rollers; a track forming a path over which the base may travel, wherein the rollers firmly engage the track so that activating the first motor causes the rollers to move the base along the path; a support frame having an elongate central support pole rotatably mounted to the base and a second motor coupled to the pole so that activating the second motor causes rotation of the support pole; an ornamental cover extending over the support frame; and means for independently controlling the motors to choreograph the movements of the display.

The support pole may have a flexible portion, a distal end, a cable and a motor, wherein the cable has a first end attached to the distal end of the support pole and a second end coupled to the motor so that activation of the motor pulls tension on the cable and deflects the flexible portion of the support pole.

BRIEF DESCRIPTION OF THE DRAWINGS

FIG. 4 is a functional diagram of a gear mechanism for raising and lowering a support pole;

FIG. 5 is an end view of the gear mechanism of FIG. 4;

FIG. 6 is a functional diagram of a worm gear mechanism for rotating or spinning the support pole;

DETAILED DESCRIPTION

The present invention relates to a method and apparatus for creating an animated display. More particularly, the present invention incorporates a unique combination of motions and appearances which can be controlled and choreographed with the use of a computer or other control devices. One specific embodiment is a tree-like sculpture which can be instructed to move and dance along with selected music for purposes of entertainment. Similarly, the invention may take on many other shapes and forms, including commercial products, mascots, religious symbols, decorative configurations and sculptures, and any other design that would be desirable to put on public display in three dimensional motion.

The present invention provides an apparatus capable of making multiple motions simultaneously with each motion being independent of the others. In this manner, the apparatus can be made to control motions independently or in any combination to produce a complex sequence of movements. The movements may be controlled in various styles and arrangements according to the creativity of the person controlling or programming the device. It is preferred that the apparatus be controlled to create an appearance of dancing in time with music supplied by others.

Figures 1, 7A, 7B, 7C:
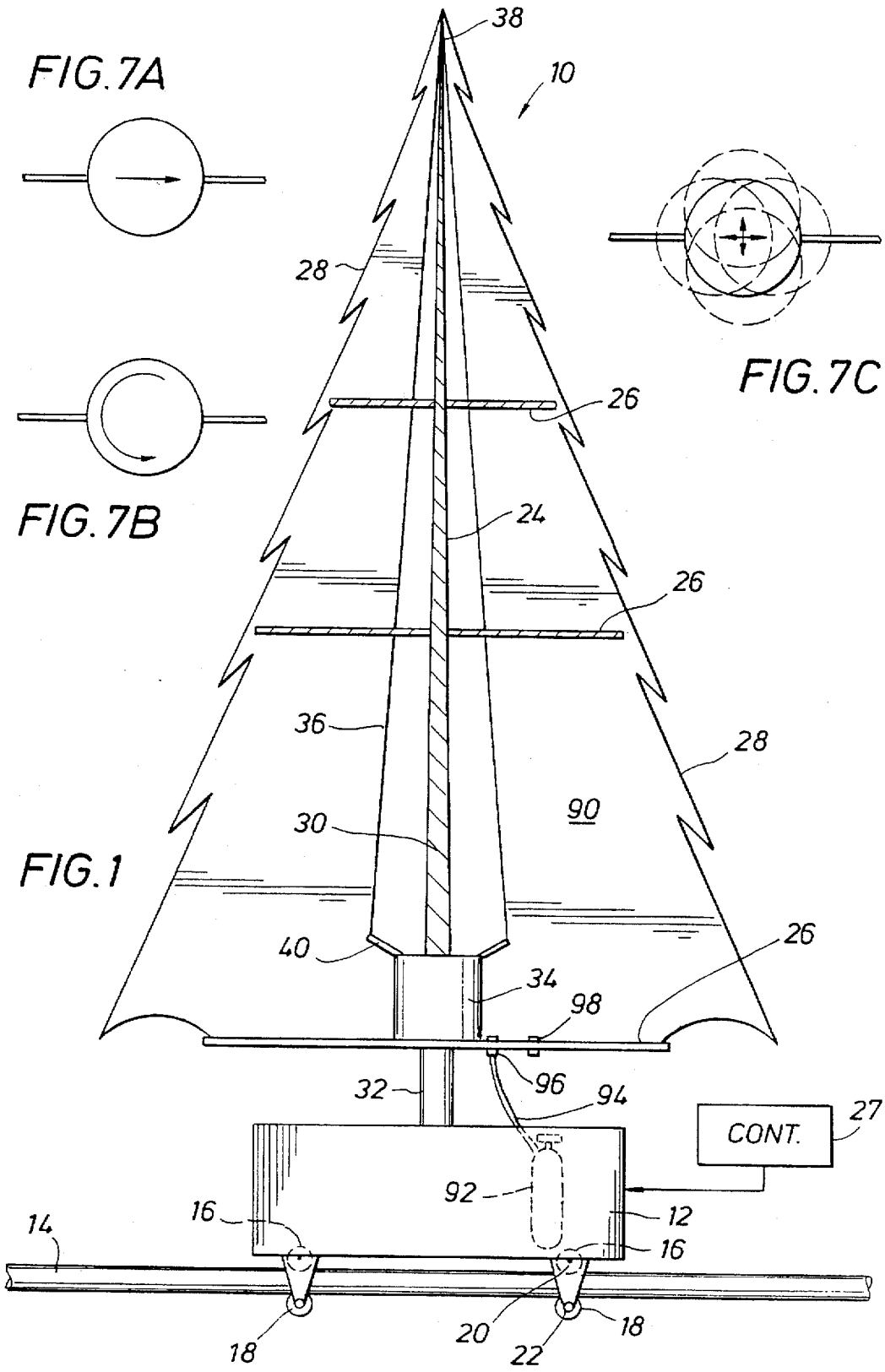
FIG. 1 is a schematic side view of an animated display.
FIG. 7A, 7B and 7C are top conceptual views illustrating linear motions, rotating or spinning motions and swaying motions, respectively, in accordance with the present invention.

FIG. 1 illustrates the basic structure of an animated display 10 of the present invention. The display 10 has a base 12 coupled to a track 14 by a set of top rollers 16 and bottom rollers 18. The base 12 contains certain mechanical and electrical components, including a motor coupled to at least one of the rollers 16,18 so that activating the motor causes the base 12 to move linearly along the path defined by the track 14. It should be recognized that any method of coupling a motor to a drive roller may be employed in the present invention including, but not limited to, gears, chains, belts and direct transmission.

The rollers 16,18 firmly engage the dual rail track 14 so that the base does not wobble or slip. The rollers 16,18 will typically be made of a plastic material, such as polyurethane, with sufficient pliability to grip the track 14 without requiring great amounts of pressure. The rollers 16,18 can be tightened about the track by adjusting the distance between the roller axles 20,22 by various means, such as set screws.

A support frame, comprised of a substantially vertical support pole 24 and support rods 26 (as needed), extends upward from the base 12. The frame is designed to hold a particular ornamental coveting 28, shown in FIG. 1 as a tree. The number and length of the support rods 26 and the height of the support pole 24 may be modified to accommodate various ornamental covers. It is anticipated that covers may take almost any shape, including Christmas trees and decorations, religious symbols, large mockups of commercial products, mascots, characters, emblems and the like. More particularly, the covers may take on the shapes and character of such diverse objects as plants (trees), food (eggs), utensils (spoons), commercial products (cans), household items (boxes), and the like.

FIG. 1 shows the support pole 24 having a rigid portion 32 extending upward to an adapting collar 34 which receives a flexible portion 30. The flexible portion 30 can be deflected or bent in various directions to create a swaying motion by pulling tension on a cable 36 having a first end attached near the distal end 38 of the support pole 24. The second end of the cable 36 is attached to means for pulling the cable, such as an electronically activated lever arm 40 or a motorized winch or pulley. A controller 27 cooperates with the mechanical and electrical components within the base 12 and is used to control the movements of the animated display. As mentioned previously, the controller can be operated by a person or a programmed device such as a computer.

Figure 2:
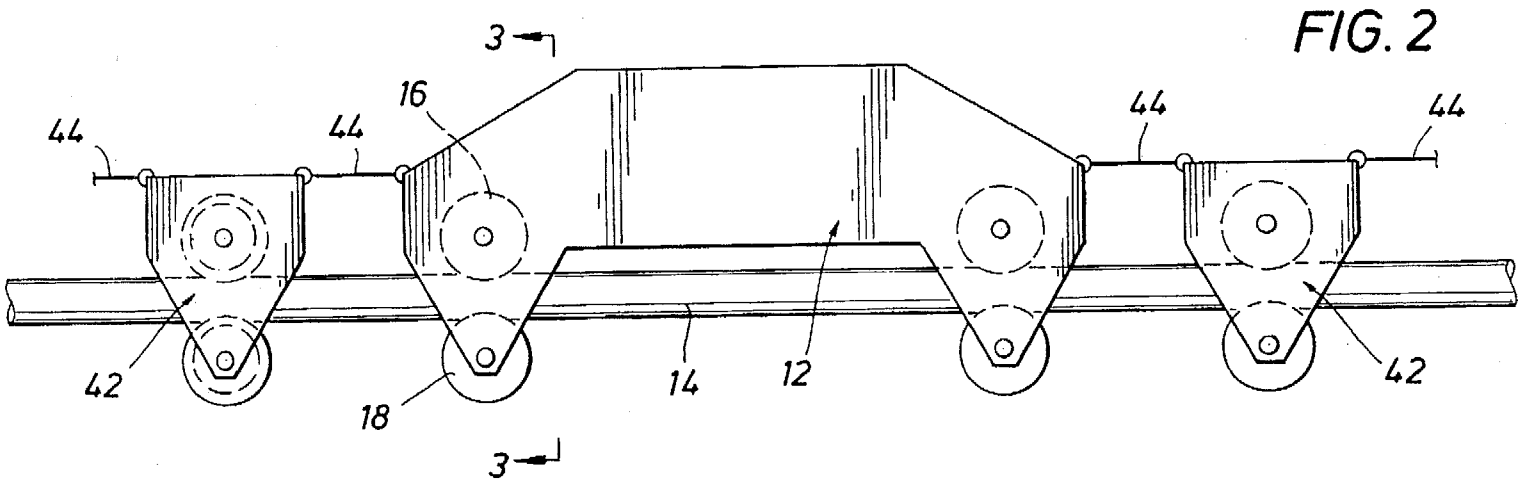
FIG. 2 is a side view of a base roller system including linking rollers.

Now referring to FIG. 2, the display of the present invention, may include multiple units as described above and illustrated in FIG. 1. These units 10 may be coupled together using a linking runner 42 between each base 12. Cables 44 attach each linking runner 42 to the adjacent base 12 to maintain certain spacing between bases and to provide the flexibility needed to accommodate tracks with curves and/or hills.

Figure 3:
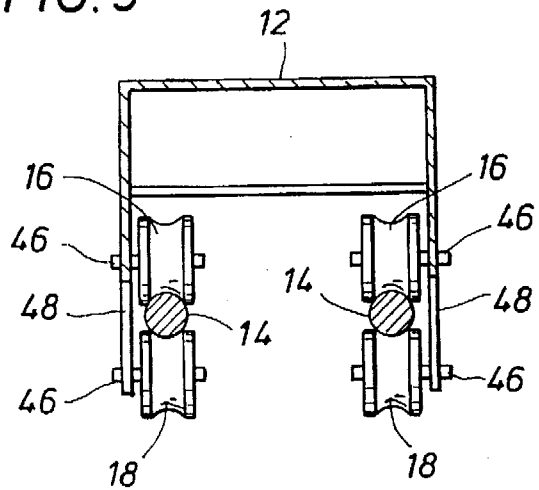
FIG. 3 is an end view of the base roller system of FIG. 2.

Now referring to FIG. 3, a cross-sectional view of the base 12 illustrates the configuration of the rollers 16,18 engaging the dual rails of track 14. The rollers 16,18 have a contour that is generally concave to mate with the round rail of the track 14. As previously described, there is a roller 16 above each rail and a roller 18 below each rail to securely grasp the rail. Each roller may have a separate axle 46, as shown, extending inward from the side 48 of the base 12 or, alternately, each pair of horizontally adjacent rollers may have a common axle spanning between the sides 48. It may be particularly preferred to have at least one spanning axle for purposes of coupling a drive motor having a gear to an axle having a worm gear to provide movement of the base 12.

Now referring to FIG. 4, a mechanism 50 is shown for bobbing and spinning the rigid portion 32 of the support pole 24 as guided by a collar bearing 68. The mechanism 50 has a round gear 52 having a central axle 54 fixed in place by attachment to the wall 48 of the base 12 (not shown). This round gear 52 has teeth 60 around its entire perimeter which engaged with and are driven by the teeth 62 of a second smaller round gear 56 having a central axle coupled with a motor. When the motor is activated to rotate the gear 56, the gear 52 is rotated about the axle 54. The gear 52 has a circular slot 64 cut into the back surface which does not penetrate through to the front surface. The slot 64 has a width only marginally greater than the width of a pin 66 which is part of a rotatable collar 67 confined to a slot 69 (see also FIG. 5) encircling the rigid portion 32 of the support pole 24. The pin 66 extends into and is slidably engaged with the slot 64. In this configuration, rotation of the gear 52 forces the pin 66, collar 67 and rigid member 32 upward. After a 180 degree rotation of the gear 52, the pin 66, collar 67 and rigid member 32 will lower back to the position shown.

Now referring to FIG. 5, a method for reducing the number of motors required to operate the display is shown. By attaching the drive gear 56 to the spanning axle 58 of a pair of rollers 16, movement of the base 12 supplies rotation to the rollers 16 and therefore to the gear 56. The drawback of this arrangement is the loss of control over the up/down or bobbing motion independent of base movement. However, the sensitivity of the bobbing motion relative to the base movement could be customized according to the relative sizes of the gear 52 and gear 56.

Now referring to FIG. 6, a cross-sectional view of the mechanism 50 taken along line 6 of FIG. 4 is shown. The mechanism has a pair of rollers 18 having a spanning axle 72 with a worm gear 74. As previously described, this embodiment uses the movement of the base to power the rollers 18. The worm gear 74 is engaged with the teeth 76 of horizontal gear 78 which is concentrically dispose around the rigid member 32 of the support pole 12. As the axle 72 and worm gear 74 rotate about a horizontal axis (shown at 80), the worm gear 74 imparts rotation on the gear 78 about a vertical axis (shown coming out of the page at point 82). The gear 78 is equipped with pins 84 which slidably engage the vertical slots 86 cut into the rigid member 32 (see also FIGS. 4 and 5).

Therefore, as shown in FIGS. 4, 5 and 6, the mechanism 50 can impart both bobbing and spinning motions upon the rigid member 32 which causes the support pole 24 to bob and spin accordingly. Note that either motion can be independently controlled simply by providing motor drives for gears 56 and 74.

Figure 7F:
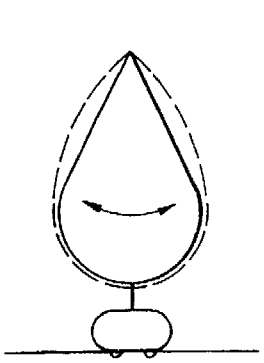
FIG. 7D, 7E, 7F and 7G are side conceptual views illustrating a bobbing, swaying, expanding and tumbling motions, respectively in accordance with the present invention.
Figure 7E:
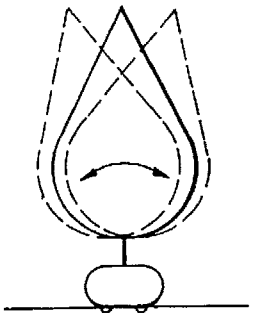
Figure 7D:
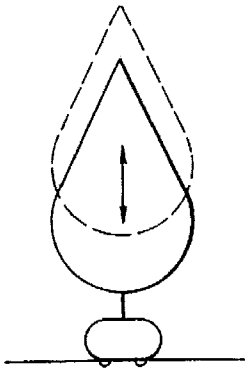
Figure 7G:
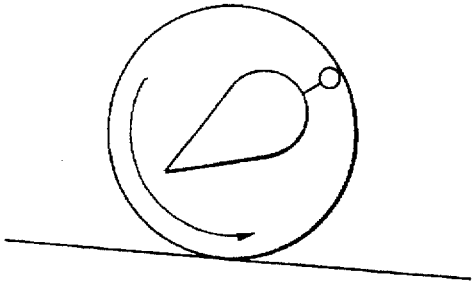

FIGS. 7A to 7G are simple schematics illustrating the various motions that are attainable with the display of the present invention. FIG. 7A is a top view illustrating linear motion of the display along the track. FIG. 7B is a top view illustrating the spinning motion imparted upon the display about its axis. FIG. 7B is another top view illustrating the swaying motion in four different directions. FIG. 7D is a side view illustrating the bobbing motion of the support pole and ornamental cover. FIG. 7E is a side view further illustrating the side-to-side swaying motion of FIG. 7C. FIG. 7G is a side view illustrating the tumbling motion obtained when the track is formed into a loop.

FIG. 7F illustrates the general motion of the ornamental cover expanding or breathing. Referring back to FIG. 1, breathing can be achieved where the ornamental covering 28 forms an air tight chamber 90 or where a rubber inner-tube is provided beneath at least a portion of the ornamental covering 28. A compressed air cylinder 92 can be provided within the base 12 to supply air pressure through line 94 to input control valve 96. When the cover 28 is to be expanded, the control valve 96 is opened. When the pressure inside the cover 28 is to be release, the output control valve 98 is opened. It is preferred that the input control valve 96 and the output control valve 98 be opened and closed remotely by an electronic signal.

Figure 8A:
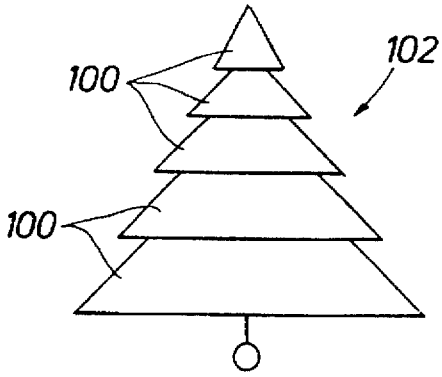
FIG. 8A shows an ornamental cover in the shape of a tree using independent conical segments.
Figure 8B:
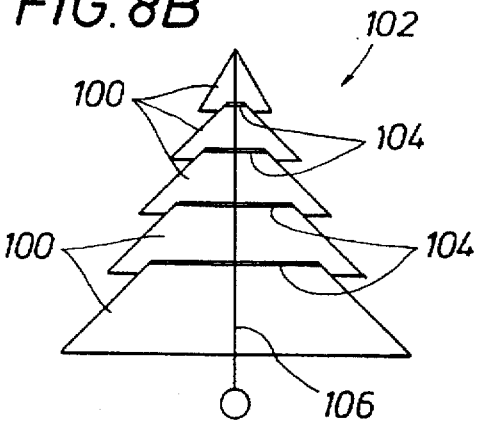
FIG. 8B is a cross-sectional view of the ornamental cover of FIG. 8A.

While the ornamental covers of the present invention may take on any form, the remaining FIGS., 8A, 8B, 9, 10A and 10B, illustrate various specific styles of ornamental coverings. FIG. 8A shows a Christmas tree 102 made of 4 inverted-funnel shaped segments 100. Referring to FIG. 8B, a cross-sectional view of the same Christmas tree 102 is shown which better illustrates the construction and attachment of the segments 100. Each of the segments 100 is independently attached to the support frame members 104 extending from the support pole 106.

Figure 9:
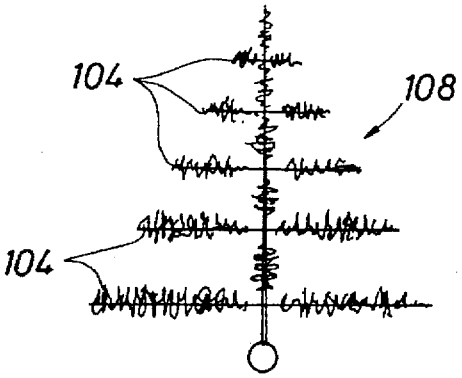
FIG. 9 is a side view of an ornamental cover having individual branches extending from the support pole.

FIG. 9 illustrates a covering 108 which is not capable of being inflated or expanded in a breath-like manner. Rather the individual support frame members 104 have been covered with needles or leaves to create a branch-like appearance. It should be recognized that the frame members may be covered in any fashion and still fall within the scope of the present invention.

Figure 10A:
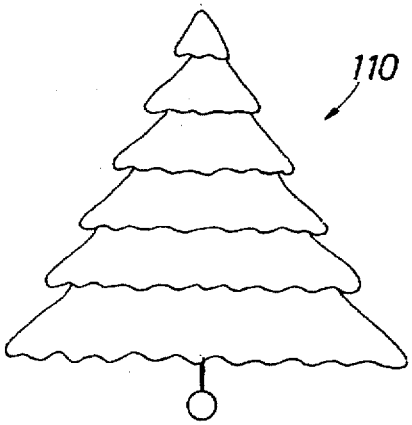
FIG. 10A is a side view of a continuous ornamental cover in the shape of a tree.
Figure 10B:
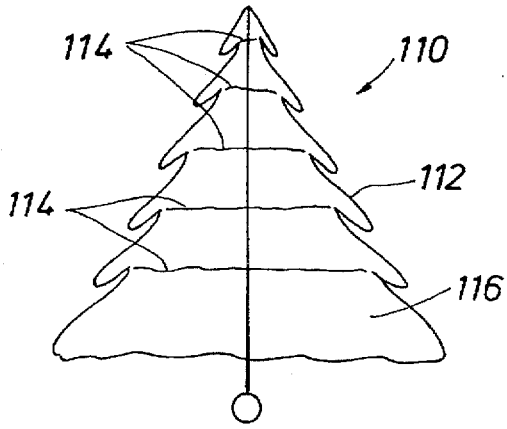
FIG. 10B is a cross-sectional view of the ornamental cover of FIG. 10A.

FIG. 10A has an ornamental covering 110 similar to that of FIG. 1, wherein the covering 110 comprises only one continuous piece fabricated from fabric, flexible plastic or rubber material. FIG. 10B is a cross-sectional view of the covering 110 of FIG. 10B more particularly showing the continuous barrier 112 attached the frame members 114. When a covering of this configuration is made of flexible plastic or rubber-like materials, it is possible to form an air tight chamber 116 which can be inflated or expanded as previous described in reference to FIG. 1.

It will be understood that certain combinations and subcombinations of the invention are of utility and may be employed without reference to other features in subcombinations. This is contemplated by and is within the scope of the present invention. As many possible embodiments may be made of this invention without departing from the spirit and scope thereof, it is to be understood that all matters hereinabove set forth or shown in the accompanying drawing are to be interpreted as illustrative and not in a limiting sense.

While the foregoing is directed to the preferred embodiment, the scope thereof is determined by the claims which follow:

What is claimed is:

1. A mechanical display for producing choreographed movement of an ornamental object, the display comprising:

a base having a set of rollers and a first motor coupled to at least one of the rollers;

a track forming a path over which the base may travel, wherein the rollers firmly engage the track so that activating the first motor causes the rollers to move the base along the path;

a support frame having an elongate central support pole rotatably mounted to the base and a second motor coupled to the pole so that activating the second motor causes rotation of the support pole;

an ornamental cover extending over the support frame; and means for independently controlling the motors to choreograph the movements of the display.

2. The display of claim 1 wherein the support pole has a flexible portion, a distal end, a cable and wherein the cable has a first end attached to the distal end of the support pole and a second end coupled to said second motor so that activation of the motor pulls tension on the cable and deflects the flexible portion of the support pole.

3. The display of claim 1 wherein the support pole is flexible and further comprises a pair of opposing cables each having a first end attached near the distal end of the support pole and a second end coupled to means for pulling the cable to deflect the support pole.

4. The display of claim 1 wherein the support pole further comprises a telescoping portion and said second motor coupled thereto so that activation of the motor causes the telescoping portion of the support pole to rise.

5. The display of claim 1 wherein the ornamental cover forms a substantially air tight inner tube, and wherein the ornamentals cover comprises an inlet valve connected to a source of pressurized gas and an outlet valve for releasing gas so that the cover can be inflated and deflated to give the appearance of breathing.

6. The display of claim 5 wherein the ornamental cover is shaped like a tree.

7. The display of claim 1 wherein the ornamental cover is shaped like a tree having a plurality of independent overlapping conical segments formed concentrically around the support frame, wherein the segments are spaced substantially equally over the support frame, each conical segment slopes substantially the same, and the segments have a steadily increasing diameter along said ornamental cover.

8. The display of claim 1 wherein the ornamental cover is shaped like a tree, the cover comprising a plurality of branches extending radially from the support pole.

9. The display of claim 1 wherein the track is substantially horizontal.

10. The display of claim 1 wherein the track is looped and has a diameter, and the support pole has a specified height less than said diameter.

11. The display of claim 1 wherein the motors and valves are controlled by electronic signals at the command of an operator.

12. The display of claim 1 wherein the motors are separately controlled by means of a controller cooperating with said motors.

13. The display of claim 1 wherein the ornamental cover is shaped like a tree, the cover comprising a plurality of branches extending radially from the support pole.

14. The display of claim 1 wherein the track is substantially horizontal.

* * * * *